United States Patent [19]

Inada et al.

[11] Patent Number: 4,999,618

[45] Date of Patent: Mar. 12, 1991

[54] DRIVING METHOD OF THIN FILM EL DISPLAY UNIT AND DRIVING CIRCUIT THEREOF

[75] Inventors: Shuji Inada; Toshihiro Ohba; Hiroshi Kishishita, all of Nara; Hisashi Uede, Wakayama, all of Japan

[73] Assignee: Sharp Kabushiki Kaisha, Osaka, Japan

[21] Appl. No.: 208,045

[22] Filed: Jun. 17, 1988

[30] Foreign Application Priority Data

Jun. 17, 1987 [JP] Japan ..... 62-150958

[51] Int. Cl.[5] ..... G09G 3/30

[52] U.S. Cl. ..... 340/781; 340/785; 340/805; 315/169.3

[58] Field of Search ..... 340/781, 785, 805, 789; 315/169.3

[56] References Cited

U.S. PATENT DOCUMENTS 4,237,456 12/1980 Kanatani ..... 340/781
4,338,598 7/1982 Ohba et al. ..... 340/781
4,652,872 3/1987 Fujita ..... 340/781
4,686,426 8/1987 Fujioka et al. ..... 340/781
4,707,692 11/1987 Higgins et al. ..... 315/169.3

*Primary Examiner*—Alvin E. Oberley
*Assistant Examiner*—M. Fatahiyar

[57] ABSTRACT

A driving method of a thin film EL display unit and a driving circuit thereof comprising a thin film EL panel constituted by installing an EL layer between scanning-side electrodes and data-side electrodes and driver ICs which are connected respectively to the scanning-side electrodes and the data-side electrodes, wherein, on a drive which applies a write voltage positive to the data-side electrodes to the scanning-side electrodes, the scanning-side electrodes are raised once to a predetermined potential or higher, and thereafter the positive write voltage is applied thereto, and on a drive which applies a write voltage negative to the data-side electrodes to the scanning-side electrodes, the scanning-side electrodes are reduced once to a predetermined potential or lower, and thereafter the negative write voltage is applied thereto, which can reduce a maximum voltage applied to the scanning-side driver ICs.

16 Claims, 3 Drawing Sheets

DRIVING METHOD OF THIN FILM EL DISPLAY UNIT AND DRIVING CIRCUIT THEREOF

BACKGROUND OF THE INVENTION

1. Field of the Invention

The present invention relates to a driving method of a thin film EL display unit and a driving circuit thereof, and specifically it relates to reduction of the withstand voltage of driver ICs employed therein.

2. Description of the Related Art

For example, a thin film EL element of double insulation type (or three-layered structure) is constituted as follows:

As shown in FIG. 5, band-shaped transparent electrodes 2 composed of $In_2O_3$ are installed in a parallel fashion on a glass substrate 1, and a dielectric substance 3, for example, $Y_2O_3$, $Si_3N_4$ or $Al_2O_3$, an EL layer 4 composed of ZnS doped with an activator such as Mn, and a dielectric substance 3' such as $Y_2O_3$, $Si_3N_4$, $TiO_2$ or $Al_2O_3$ like the above-mentioned are laminated in sequence in film thicknesses of 500–10000 Å to form a three-layered structure by the use of a thin film technique such as a vacuum evaporation method or a sputtering method, and thereon band-shaped back electrodes 5 composed of Aλ are installed in a parallel fashion in the direction orthogonal to the above-mentioned transparent electrodes 2.

The above-mentioned thin film EL element comprises the EL substance 4 sandwiched between the dielectric substances 3 and 3' between the electrodes thereof, and therefore can be viewed equivalent to a capacitive element. Also, this thin film EL element is driven with a relatively high voltage of about 200V applied. This thin film EL element emits a high-luminance light by an AC electric field, having a feature of long life.

Conventionally, to reduce the modulation power consumption in a display unit using such a thin film EL element, a driving apparatus has been used which provides an N-channel MOS driver and a P-channel MOS driver as a driving circuit of the scanning-side electrodes, and performs field inversion drive which inverts the polarity on a field basis (line sequential drive of one screen). Furthermore, in the U.S. Pat. application Ser. No. 864,509 filed on May 19, 1986 (the counterpart in West Germany is Application No. P3619366.6 filed on June 9, 1986), this applicant provided a driving apparatus wherein a driver IC of push-pull configuration is used on the data side, and the waveforms of the whole pulse voltages of positive and negative polarities applied to picture elements of an EL panel are controlled to eliminate a burning phenomenon due to polarization and thereby the long-term reliability is enhanced, and the power consumption is also reduced.

Description is made on a conventional driving method in reference to FIG. 4. In addition, in FIG. 4, to simplify the matrix structure of an EL panel, for the data-side electrodes, a group of light-emitting picture element electrodes is designated by Xi and a group of non-lightemitting picture element electrodes is designated by Xj. Also, for a group of the scanning-side electrodes, since the EL panel is driven in a line sequential fashion, a lightemitting electrode is designated by Ym, and a group of non-light-emitting electrodes is designated by Yn.

In this equivalent circuit, by turning off switches 28 and 29, all the scanning-side electrodes can be put in the floating state in any state of transistors 25, 26, 25' and 26' in scanning-side driver ICs 30. Next, description is made on a method of applying the modulating voltage. This is classified into the following two kinds of drives. ①P drive (drive which applies a write voltage positive to the data-side electrodes to the scanning-side electrodes)

Transistors 22 and 23 in a data-side driver IC 31 are turned on and transistors 21 and 24 therein are turned off, and thereafter a switch 27 is turned on. Thereby a current flows from the transistors 23 to the ground through all EL picture elements connected to the group of electrodes Xj, further through all EL picture elements connected to the group of electrodes Xi, and through the transistor 22. Thereby, the potential of the group of electrodes Xi is clamped at OV and the potential of the group of electrodes Xj is clamped at Vm, and an application of the modulating voltage is completed.

By applying the modulating voltage, the potential of the group of electrodes Xi is kept at OV, and the potential of the group of electrodes Xj is kept at Vm. The potential of the scanning-side electrodes Ym and Yn at this time is determined by the ratio of the number of light-emitting picture elements Cb to that of non-light-emitting picture elements Cbn, and the potential is $Vs=\{Cbn/(Cb+Cbn)\}Vm$.

From this state, the transistor 25 connected to the light-emitting electrode Ym of the scanning-side driven IC 30 is turned on, and the transistor 26 connected thereto is turned off, and simultaneously the transistor 26' connected to the group of non-light-emitting electrodes Yn is turned on and the transistor 25' connected thereto is turned off, and thereafter the switch 29 is turned on, and thereby a positive write voltage Vpd is applied to the transistors 25 and 25'. Resultingly, the voltage Vpd is applied to the group of light-emitting picture elements Cb, and a voltage $Vpd-Vm$ is applied to the group of non-light-emitting picture elements Cbn. Here, the positive write voltage Vpd is equal to a sum of a light emitting threshold voltage Vth of the EL panel (a maximum voltage which does not cause the picture elements to emit light) and the modulating voltage Vm ($Vpd=Vth+Vm$). Accordingly, the picture elements Cb emit light because of $Vpd>Vth$, and the picture elements Cbn emit no light because of $Vpd-Vm=Vth$, and thereby two kinds of states, light emission and non-light emission can be realized. ②N drive (drive which applies a write voltage negative to the data-side electrodes to the scanning-side electrodes)

The modulating voltage is applied in a manner that "ONs" and OFFs" of the transistors 21, 22, 23 and 24 as described in the P drive in item ①are changed over, and thereby the potential of the group of electrodes Xi is clamped at Vm, and the potential of the group of electrodes Xj is clamped at OV.

From this state, the transistor 26 connected to the light-emitting electrode Ym of the scanning-side driver IC 30 is turned on and the transistor 25 connected thereto is turned off, and simultaneously, the transistor 25' connected to the group of non-light-emitting electrodes Yn is turned on and the transistor 26' connected thereto is turned off, and thereafter the switch 28 is turned on, and thereby a negative write voltage -Vnd is applied to the transistors 26 and 26'. Resultingly, a potential Vm - (−Vnd) is applied to the group of light-emitting picture elements Cb, and a potential OV-(−Vnd) is applied to the group of non-light-emitting picture elements Cbn. Here, by setting the negative write voltage Vnd equally to the light emitting threshold voltage Vth, the picture elements Cb emit light because of Vm+Vnd>Vth, and the picture elements Cbn emit no light because of Vnd=Vth, and thereby two kinds of states can be realized.

However, in the above-mentioned driving method, during application of the modulating voltage, the potential Vs of the scanning-side electrodes Ym and Yn are varied between OV and Vm depending on the ratio of the number of picture elements of the group of light-emitting picture elements Cb to that of the group of non-light-emitting picture elements Cbn in the EL panel Consequently, in the P drive, when the potential Vs of the scanning-side electrodes Ym and Yn is OV, the positive write voltage Vpd (=Vth+Vm) is applied to the transistors 25 and 25', and a maximum potential difference Vth+Vm is applied to the transistors 25 and 25', and in the N drive, when the potential Vs of the scanning-side electrodes Ym and Yn is the potential Vm, the negative write voltage -Vnd (=−Vth) is applied to the transistors 26 and 26', and the maximum potential difference Vth+Vm is applied to the transistors 26 and 26', and therefore a driver IC to be used is required to have a very high withstand voltage.

SUMMARY OF THE INVENTION

The present invention concerns a driving method of a thin film EL display unit, wherein, in the case where the potential of scanning-side electrodes is put in the floating state, a modulating voltage Vm is selectively applied to data-side electrodes through a data-side driver IC, in order to selectively cause respective picture elements to emit light which are formed at crossing portions of the above-mentioned scanning-side electrodes and data-side electrodes, and thereafter a write voltage is applied to the scanning-side electrodes through scanning-side driver ICs;

on a drive which applies a write voltage positive to the data-side electrodes to the scanning-side electrodes, the potential of the scanning-side electrodes is raised once to a first predetermined potential or higher, and thereafter the positive write voltage is applied to the scanning-side electrodes through the scanning-side driver IC's, and on a drive which applies a write voltage negative to the data-side electrodes to the scanning-side electrodes, the potential of the scanning electrodes is reduced once to a second predetermined potential or lower, and thereafter the negative write voltage is applied to the scanning-side electrodes through the scanning-side driver ICs.

It also provides a driving circuit of a thin film EL display unit comprising a thin film EL panel constituted by installing an EL layer between scanning-side electrodes and data-side electrodes which are arranged in the directions crossing one another, scanning-side driver ICs connected to said scanning-side electrodes, a data-side driver IC connected to said data-side electrodes, a switching circuit for selectively applying a modulating voltage Vm to each data-side electrode through said data-side driver IC in order to selectively cause respective picture elements to emit light which are formed at crossing portions of said scanning-side electrodes and dataside electrodes, a first and a second switching circuits for applying write voltages respectively positive and negative to the data-side electrodes to said scanning-side electrodes through the scanning-side driver ICs and for putting the potential of said scanning-side electrodes in the floating state, a third switching circuit for applying a first predetermined voltage to said scanning-side electrodes through the scanning-side driver ICs before the positive write voltage is applied to said scanning-side electrodes by the first switching circuit on a drive applying the write voltage positive to said data-side electrodes to said scanning-side electrodes, and a fourth switching circuit for applying a second predetermined voltage to said scanningside electrodes through the scanning-side driver ICs before the negative write voltage is applied to said scanning-side electrodes by the second switching circuit on a drive applying the write voltage negative to said data-side electrodes to said scanning-side electrodes.

DESCRIPTION OF THE PREFERRED EMBODIMENTS

Figure 4:
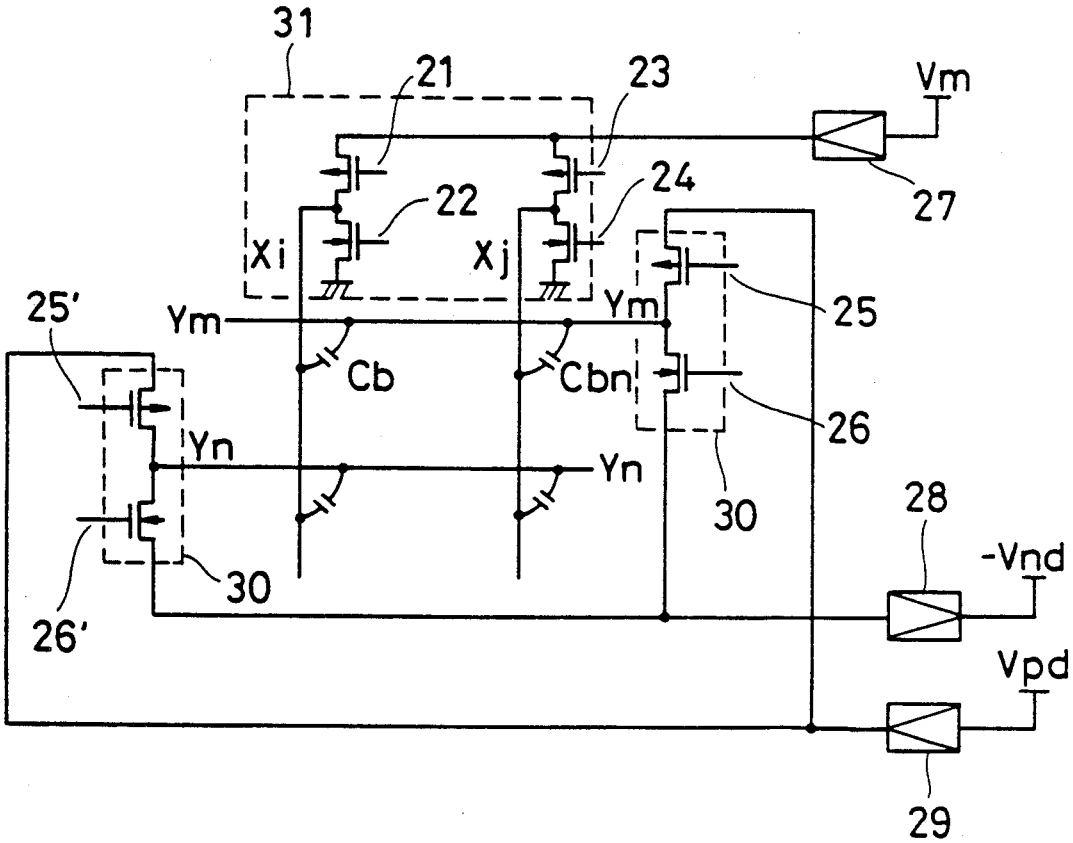
FIG.4 (PRIOR ART)
FIG. 4 is an equivalent circuit diagram of a conventional driving circuit.
Figure 5:
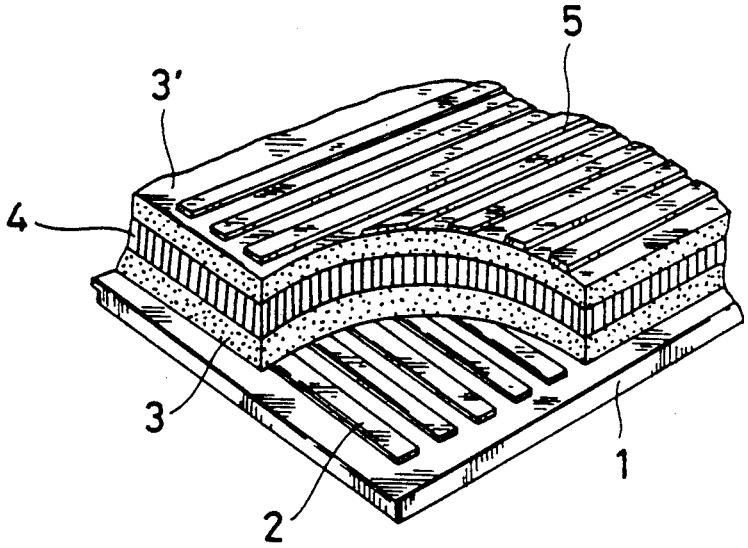
FIG. 5 is a partly-cut-off perspective view of a thin film EL element.

Hereinafter, detailed description is made on an embodiment in accordance with the present invention in reference to FIG. 1 through FIG. 3. In addition, in FIG. 1 and FIG. 3, parts designated by the same numerals as those in FIG. 4 are assumed to have the same functions as those in FIG. 4.

Figure 1:
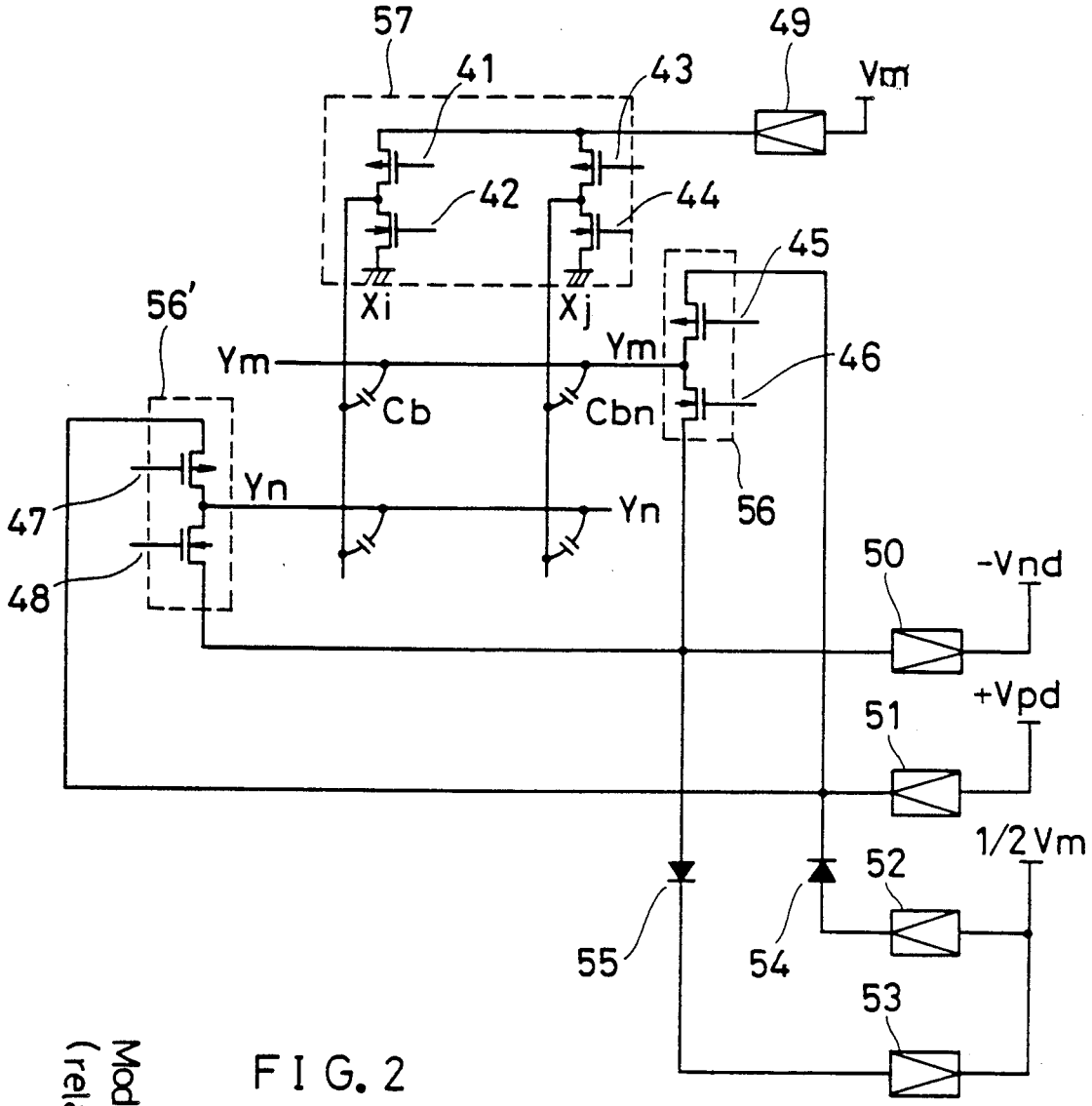
FIG. 1 is an equivalent circuit diagram showing one embodiment in accordance with the present invention.

In FIG. 1, a data-side driver IC 57 for selectively applying a modulating voltage Vm is connected to data-side electrodes Xi and Xj, and scanning-side driver ICs 56 and 56' for selectively applying a positive or negative write voltage are connected to scanning-side electrodes Ym and Yn.

In addition, numeral 49 designates a switching circuit (hereinafter referred to as a switch) for applying the modulating voltage Vm (for example, 50–60 V) to pull-upside transistors 41 and 43 of the above-mentioned data-side driver IC 57, numeral 50 designates a switching circuit (hereinafter referred to as a switch) for applying a negative write voltage -Vnd (=−Vth, Vth is, for example, 180 −190 V) to the above-mentioned scanning-side driver ICs 56 and 56', and numeral 51 designates a switching circuit (hereinafter referred to as a switch) for applying a positive write voltage Vpd (=Vth+Vm) to the abovementioned scanning-side driver ICs 56 and 56'.

Furthermore, a switching circuit (hereinafter referred to as a switch) 52 is installed which applies ($\frac{3}{4}$)Vm to pull-up-side transistors 45 and 47 of the above-mentioned scanning-side driver ICs 56 and 56' through a diode 54 connected in the forward direction, and a switching circuit (hereinafter referred to as a switch) 53 is installed which applies ($\frac{1}{2}$) Vm to pull-down-side transistors 46 and 48 of the scanning-side driver ICs 56 and 56' through a diode 55 connected in the reverse direction.

Hereinafter, description is made on a driving method of the above-mentioned driving circuit. In addition, since a method of applying the modulating voltage is similar to the one in FIG. 4, here description is made from the next step. ①P drive (drive which applies a write voltage positive to the data-side electrodes to the scanning-side electrodes)

By applying the modulating voltage, the potential of a group of electrodes Xi is kept at OV, and the potential of a group of electrodes Xj is kept at Vm. The potential of the scanning-side electrodes Ym and Yn at this time is determined by the ratio of the number of light-emitting picture elements Cb to that of non-light-emitting picture elements Cbn, and the potential is $Vs=\{Cbn/(Cb+Cbn)\}Vm$.

Here, in the case where all of the pull-up-side transistors 45 and 47 of the scanning-side driver ICs 56 and 56' connected to the scanning-side electrodes Ym and Yn put in the floating state are turned on and the switch 52 is turned on, and thereby the potential of the scanning-side electrodes Ym and Yn is $Vs \geqq (\frac{1}{2})Vm$, that is, in the case of number of light-emitting picture elements $Cb \leqq$ the number of non-light-emitting picture elements Cbn, a current is charged through the diode 54, and the potential Vs of the scanningside electrodes Ym and Yn is raised to $(\frac{1}{2})Vm$. Also, in the case where the potential of the scanning-side electrodes Ym and Yn is $Vs \geqq (\frac{1}{2})Vm$, that is, in the case of the number of light-emitting picture elements $Cb \leqq$ the number of nonlight-emitting picture elements Cbn, a back flow of the current is cut by the diode 54 to prevent an extra current from flowing.

As mentioned above, the potential of the scanning-side electrodes Ym and Yn are kept between $(\frac{1}{2})Vm$ and Vm all the time, and therefore when the positive write voltage Vpd is applied to these electrodes in the following step, a potential difference of $Vpd-(\frac{1}{2})Vm$ at a maximum is applied to the transistors 45 and 47 of the scanning-side driver IC 56, and thereby the withstand voltage of the driver IC is alleviated by $(\frac{1}{2})Vm$ in comparison with the conventional maximum voltage difference Vpd.

From this state, the transistor 45 connected to the light-emitting electrode Ym of the scanning-side driver IC 56 is turned on and the transistor 46 connected thereto is turned off, and simultaneously the transistor 48 connected to the group of non-light-emitting electrodes Yn is turned on and the transistor 47 connected thereto is turned off, and thereafter the switch 51 is turned on, and thereby the positive write voltage Vpd is applied to the transistors 45 and 47. Resultingly, the potential Vpd is applied to the group of light-emitting picture elements Cb, and the potential of $Vpd-Vm$ is applied to the group of the nonlight-emitting picture elements Cbn, and the picture elements Cb emit light and the picture elements Cbn emit no light, and thus two kinds of states can be realized. ②N drive (drive which applies a write voltage negative to the data-side electrodes to the scanning-side electrodes)

By applying the modulating voltage, the potential of the group of electrodes Xi is kept at Vm, and the potential of the group of electrodes Xj is kept at OV. The potential of the scanning-side electrodes Ym and Yn at this time is determined by the ratio of the number of the light-emitting picture elements Cb to that of the non-light-emitting picture elements Cbn, and the potential is $Vs=\{Cb/(Cb+Cbn)\}Vm$.

Here, in the case where all of the pull-down-side transistors 46 and 48 of the scanning-side driver ICs 56 and 56' connected to the scanning-side electrodes Ym and Yn put in the floating state are turned on and the switch 53 is turned on, and thereby the potential of the scanning-side electrodes Ym and Yn is $Vs \leqq (\frac{1}{2})Vm$, that is, in the case of the number of light emitting picture elements $Cb \leqq$ the number of non-light-emitting picture elements Cbn, a current is drawn out through the diode 55, and thereby the potential Vs of the scanning-side electrodes Ym and Yn can be reduced to $(\frac{1}{2})Vm$. Also, in the case where the potential of the scanning-side electrodes Ym and Yn is $Vs \leqq (\frac{1}{2})Vm$, that is, in the case of the number of light-emitting picture elements $Cb \leqq$ the number of non-light-emitting picture elements Cbn, a back flow of the current is cut by the diode 55 to prevent an extra current from flowing As mentioned above, the potential Vs of the scanning side electrodes Ym and Yn is kept between OV and $(\frac{1}{2})Vm$ all the time, and when the write voltage -Vnd is applied to these electrodes in the following step, a potential difference of $(\frac{1}{2})Vm-(-Vnd)$ at a maximum is applied to the transistors 46 and 48 in the scanning-side driver ICs 56 and 56', and the outstand voltage of the driver ICs is alleviated by $(\frac{1}{2})Vm$ in comparison with the conventional maximum potential difference $Vm-(-Vpd)$.

From this state, the transistor 46 connected to the light-emitting electrode Ym of the scanning-side driver IC 56 is turned on and the transistor 45 connected thereto is turned off, and simultaneously the transistor 47 connected to the group of non-light-emitting electrodes Yn is turned on and the transistor 48 connected thereto is turned off, and thereafter the switch 50 is turned on, and thereby the negative write voltage $-Vnd$ is applied to the transistors 46 and 48. Resultingly, a potential $Vm-(-Vnd)$ is applied to the group of light-emitting picture elements Cb, and a potential $OV-(-Vnd)$ is applied to the group of non-lightemitting picture elements Cbn, and the picture elements Cb emit light and the picture elements Cbn emit no light, and thus two kinds of states can be realized.

Figure 2:
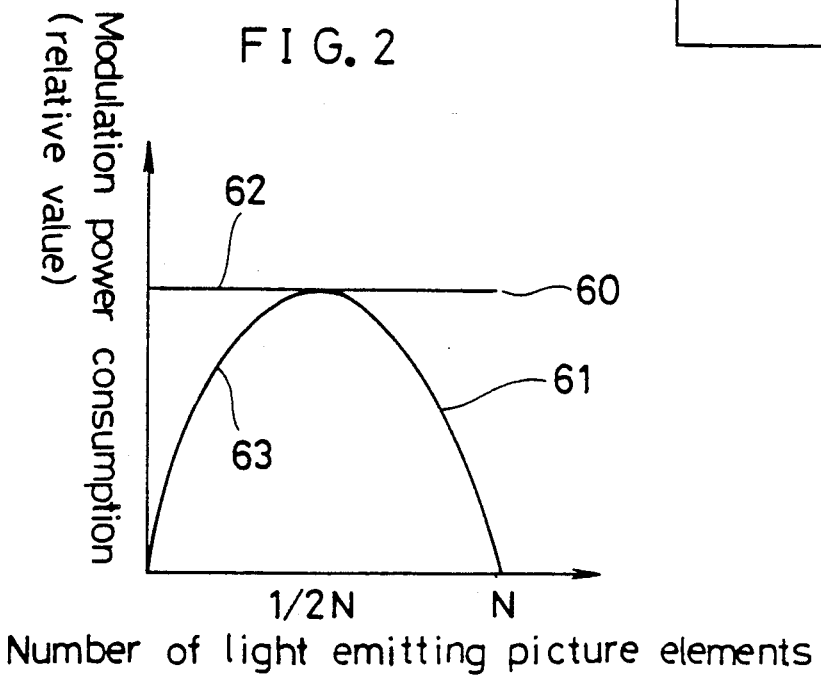
FIG. 2 is a graph showing power consumptions in a conventional apparatus and the embodiment in FIG. 1.

FIG. 2 shows a relationship between the modulation power consumption and the number of light-emitting picture elements.

In accordance with the conventional driving method, the curve of power consumption takes a maximum value when the ratio of the number of the light-emitting picture elements Cb to that of the non-light-emitting picture elements Cbn is 1 : 1, and the power consumptions before and after that value decrease in a parabola shape as shown by lines 63 and 61. However, as to the withstand voltage, since a high voltage is applied as described above, the withstand voltage is not alleviated.

In accordance with this embodiment, in the range of $0-(\frac{1}{2})N$ (N, the number of data lines) of the number of lightemitting picture elements, the curved line 63 is drawn, and in the range of $(\frac{1}{2})N-N$, the line becomes flat. In general, the ratio of light emission of the EL display is about 30%, and therefore the panel is used in the region where the power consumption decreases in a parabola shape, and the withstand voltage can be alleviated also.

Also, as a prior art, a driving method is used wherein to alleviate the withstand voltage of the scanning-side driver ICs, the modulating voltage is applied from both of the data side and the scanning side, but in this case, the potential of the scanning-side electrodes is fixed to $(\frac{1}{2})Vm$ all the time, and therefore the consumption curve is flat all the time as shown by lines 62 and 60 in FIG. 2, and the power consumption is constant and independent of the number of light-emitting picture elements, and this is inconvenient.

In addition, in the above-mentioned embodiment, the amount of alleviation of withstand voltage ($\frac{1}{2}$)Vm is supplied from a single power source, but this can be changed depending on the configuration of the drive circuit and the withstand voltage of the driver ICs.

Figure 3:
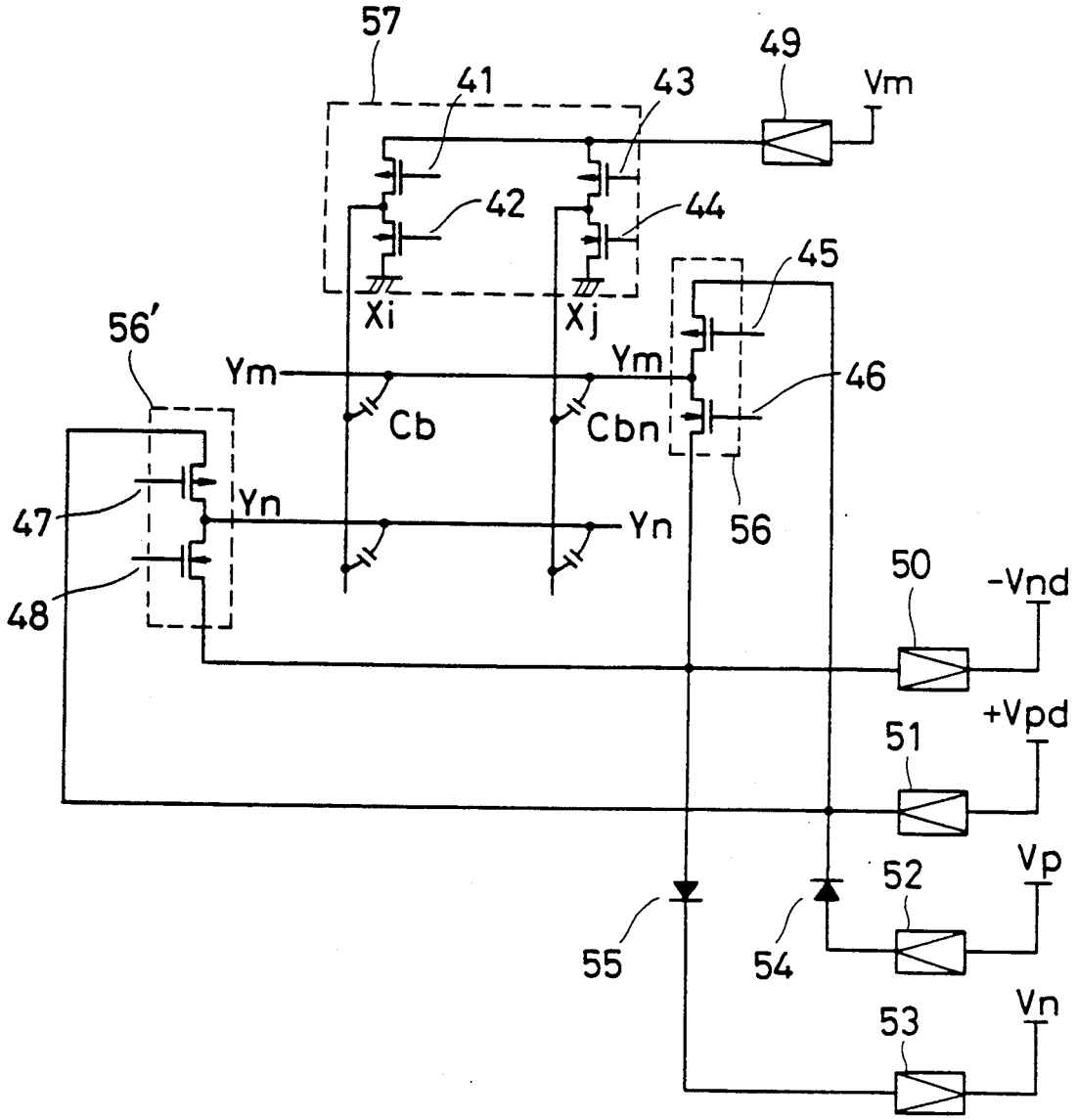
FIG. 3 is a view corresponding to FIG. 1 which shows another embodiment in accordance with the present invention.

For example, as shown in FIG. 3, two different voltages Vp and Vn may be supplied from different power sources respectively as voltages for alleviation. Note that, in this case, the voltages Vp and Vm are set within ranges of $Vth \geqq Vp > 0$ and $Vm > Vn > Vm - Vth$ to prevent each picture element from emitting light.

As described above, in accordance with the present invention, the withstand voltage of the scanning-side driver ICs can be alleviated by adding a simple circuit, and fabrication of the scanning-side driver ICs can be facilitated in terms of withstand voltage. Furthermore, in the case where the scanning-side electrodes have originally a predetermined potential or higher in P drive and have originally a predetermined potential or lower in N drive, charging and discharging of current are not performed, and therefore the present invention can provide a useful driving method and a useful driving circuit for a thin film EL display unit which can reduce a wasteful power consumption.

What is claimed is:

1. A method of driving a thin film EL display unit including a thin film EL panel with an EL layer sandwiched between a plurality of scanning-side electrodes and a plurality of data-side electrodes which are arranged in perpendicular directions crossing one another, scanning-side driver ICs connected to the scanning-side electrodes, and a data-side driver IC connected to the data-side electrodes, the method comprising the steps of:

(a) applying a modulating voltage Vm to selected of the data side electrodes through the data-side driver IC in order to selectively cause respective picture elements, formed at the crossing portions of the scanning-side electrodes and data-side electrodes, to emit light when a write voltage is applied;

(b) applying a write voltage thereafter to the scanning-side electrodes through the scanning-side driver ICs, to thus light selected picture elements;

(1) prior to step (b) of applying a write voltage, during precharge of a first field, charging the EL layer through said scanning-side electrodes, to raise the voltage potential of said scanning-side electrodes to a value at least equal to a first predetermined voltage potential, and thereafter applying a positive write voltage to said scanning-side electrodes through the scanning-side driver ICs to light selected picture elements in the first field, and (2) prior to step (b) of applying a write voltage, during precharge of a second field, discharging the EL layer through said scanning-side electrodes, to lower the voltage potential of said scanning-side electrodes to a value not greater than a second predetermined voltage potential, and thereafter applying a negative write voltage to said scanning-side electrodes through the scanning-side driver ICs to light selected picture elements in the second field.

2. A driving method according to claim 1, wherein the first and the second predetermined voltage potentials are ($\frac{1}{2}$)Vm.

3. A driving circuit of a thin film EL display unit including a thin film EL panel with an EL layer sandwiched between a plurality of scanning-side electrodes and a plurality of data-side electrodes which are arranged in perpendicular directions crossing one another, scanning-side driver ICs connected to the scanning side electrodes, a data-side driver IC connected to the data-side electrodes, comprising:

data electrode switching means for selectively applying a first modulating voltage Vm to each data-side electrode through said data-side driver IC in order to selectively cause respective picture elements, which are formed at crossing portions of said scanning-side electrodes and data-side electrodes, to emit light when a write voltage is applied;

first and a second switching means for applying write voltages, respectively positive and negative to the first modulating voltage Vm, in a first and second field, to the scanning-side electrodes through the scanning-side driver ICs and for setting voltage potential of said scanning-side electrodes in a floating state, the voltage potential being dependent upon the number of lit and unlit picture elements corresponding to each scanning-side electrodes;

third switching means for applying a second modulating voltage, different from the first modulating voltage, to said scanning-side electrodes through the scanning-side driver ICs during precharge, prior to the positive write voltage being applied to said scanning-side electrodes by the first switching means on a drive applying the write positive voltage to said scanning-side electrodes in the first field; and fourth switching means for applying a third modulating voltage, different from the first modulating voltage, to said scanning-side electrodes through the scanning-side driver ICs during precharge, prior to the negative write voltage being applied to said scanning-side electrodes by the second switching means on a drive applying the negative write voltage to said scanning-side electrodes in the second field.

4. A driving circuit according to claim 3, wherein the second and third modulating voltages are supplied from a single power source.

5. A driving circuit according to claim 3, wherein the second and third modulating voltages are ($\frac{1}{2}$)Vm.

6. A driving circuit according to claim 3, wherein the scanning-side driver ICs comprise a pull-up transistor for applying the positive write voltage to the scanning-side electrodes in the first field and a pull-down transistor for applying the negative write voltage to the scanning-side electrodes in the second field.

7. A driving circuit according to claim 6, wherein the second modulating voltage is applied from the third switching means to the pull-up transistor through a forward biased diode, and the third modulating voltage is applied from the fourth switching means to the pull-down transistor through a reverse biased diode.

8. A driving system for driving, in a first and second driving field, a display device including a plurality of data electrodes arranged in a first direction, a plurality of scan electrodes arranged in a second direction perpendicular to the first direction, picture elements formed at intersections of the scan and data electrodes, and an EL layer sandwiched between the scan electrodes and the data electrodes, the system comprising:

first switch means, connected to each of the data electrodes, for grounding data electrodes corresponding to selected picture elements during precharge of the first driving field;

second switch means, connected to each of the data electrodes, for supplying a first modulation voltage to data electrodes corresponding to non-selected picture elements during precharge of the first driving field;

third switch means, connected to each of the scan electrodes, for supplying a second modulation voltage, less than said first modulation voltage, to the scan electrodes to create a voltage potential of the scan electrodes within a first range between the first and second modulation voltages, during precharge of the first driving field;

said third switch means supplying a first driving voltage of a first polarity to said scan electrodes to light said selected picture elements during said first driving field;

said first switch means supplying said first modulation voltage to data electrodes corresponding to selected picture elements during precharge of the second driving field;

said second switch means grounding data electrodes corresponding to non-selected picture elements during precharge of the second driving field;

fourth switch means, connected to each of the scan electrodes, for supplying said second modulation voltage to create a voltage potential of the scan electrodes within a second range between zero volts and the second modulation voltage during precharge of the second driving field;

said fourth switch means supplying a second driving voltage of a second polarity, inverse to the first voltage polarity, to the scan electrodes to light said selected picture elements during said second driving field.

9. The system of claim 8, further comprising:

first voltage source, operative by connected to said first and second switch means, for producing said first modulation voltage supplied to the data electrodes;

second voltage source, operatively connected to the third and fourth switch means, for producing said second modulation voltage supplied to the scan electrodes; and third and fourth voltage source, operatively connected to the third and fourth switch means, respectively, for producing the first and second drive voltage, respectively.

10. The system of claim 9, further comprising:

first switch, operatively connecting the third voltage source and the third switch means, being activated during the first driving field to thereby supply voltage from the third voltage source to the third switch means during the first driving field; and second switch, operatively connecting the fourth switch means and the fourth voltage source, being activated during the second driving field to thereby supply voltage from the fourth voltage source to the fourth switch means during the second driving field.

11. The system of claim 10, further comprising:

third and fourth switches, operatively connecting said third and fourth switch means, respectively, to said second voltage source, each being activated during precharge of said first and second driving field, respectively, to supply voltage from the second voltage source to the third and fourth switch means during precharge of the first and second driving fields, respectively.

12. The system of claim 11, further comprising:

first diode of a first bias, operatively connecting said third switch and said third switching means, to allow said voltage from said second voltage source to act as a minimum voltage in said first range; and second diode of a bias reversed from said first diode, operatively connecting said fourth switch and said fourth switch means, to allow voltage from said second voltage source to act as a minimum voltage in said second voltage range.

13. The system of claim 8, wherein the first, second, third, and fourth switch means are MOS-transistors.

14. A driving system for driving a display device in a first and second field with a write pulse of a positive and negative polarity in each of the first and second field, respectively, the display device including a plurality of data electrodes arranged in a first direction, a plurality of scan electrodes arranged so as to intersect the data electrodes in a second direction perpendicular to the first direction, picture elements formed at the data and scan electrodes intersection, and an EL layer sandwiched between the plurality of scan and data electrodes, the system comprising:

first modulating means, operatively connected to the data electrodes, for applying a first modulation voltage to data electrodes corresponding to selected picture elements during precharge of the second field and corresponding to non-selected picture elements during precharge of the first field;

second modulating means, operatively connected to the scan electrodes, for applying a second modulation voltage to the scan electrodes, different from the first modulation voltage, to maintain a minimum voltage potential during precharge of the first field and to maintain a maximum voltage potential during precharge of the second field to therefore minimize relative power consumption necessary for lighting selected picture elements; and write voltage supply means, operatively connected to the scan electrodes, for supplying the positive polarity write pulse during the first field and for supplying the negative polarity write pulse during the second field to the scan electrodes to light the selected picture elements.

15. The system of claim 14, wherein the second modulating means includes, a single voltage source of the second modulation voltage, less than the first modulation voltage;

first and second switches operatively connected to the single voltage source, the first witch being activated during precharge of the first field and the second switch being activated during precharge of the second field; and first and second diodes, operatively connected to the scan electrodes and the first and second switches, respectively, the first diode being of a first bias to allow voltage flow of the second modulation voltage to the scan electrodes, during precharge of the first field, to thus create a minimum voltage potential of the scan electrodes corresponding to the second modulation voltage, and the second diode being of reverse bias to that of the first diode, to allow voltage flow from the scan electrodes up to the second modulation voltage, during precharge of the second field, to thus create create a maximum voltage potential of the scan electrodes corresponding to the second modulation voltage.

16. A driving method for driving, in a first and second driving field, a display device including a plurality of data electrodes arranged in a first direction, a plurality of scan electrodes arranged in a second direction perpendicular to the first direction, picture elements formed at intersection of the scan and data electrodes, and an EL layer sandwiched between the scan electrodes and the data electrodes, the method including the steps of:

(a) grounding data electrodes corresponding to selected picture elements during precharge of the first driving field;

(b) supplying a first modulation voltage to data electrode corresponding to non-selected picture elements during precharge of the first driving field;

(c) supplying a second modulation voltage, less than said first modulation voltage, to the scan electrodes to create a voltage potential of the scan electrodes within a first range between the first and second modulation voltage during precharge of the first driving field;

(d) supplying a first driving voltage of a first polarity to said scan electrodes to light said selected picture elements during said first driving field;

(e) supplying said first modulation voltage to data electrodes corresponding to selected picture elements during pre-charge of the second driving field;

(f) grounding data electrodes corresponding to non-selected picture elements during pre-charge of the second driving field;

(g) supplying said second modulation voltage to create a voltage potential of the scan electrodes within a second range between zero volts and the second modulation voltage during pre-charge of the second driving field;

(h) supplying a second driving voltage of a second polarity, inverse to the first polarity, to the scan electrodes to light said selected picture elements during said second driving field.

* * * * *